United States Patent [19]

Irik

[11] 3,976,260

[45] Aug. 24, 1976

[54] TRANSPORTABLE CABLE REEL

[75] Inventor: Harry Irik, Santa Monica, Calif.

[73] Assignee: Grantham & Oleson, Inc., Venice, Calif.

[22] Filed: Feb. 7, 1975

[21] Appl. No.: 547,768

[52] U.S. Cl. ..... 242/86.5 R; 242/77

[51] Int. Cl.[2] ..... B65H 75/18; B65H 75/40

[58] Field of Search ..... 242/86.2, 86.4, 86.5 R, 242/94, 86.6, 77, 77.2–77.4, 118.8, 125.1, 86.3, 86.7, 86.8, 85

[56] References Cited

UNITED STATES PATENTS

| | | | |
|---|---|---|---|
| 486,010 | 11/1892 | Wirt | 242/86.2 |
| 565,054 | 8/1896 | Trembly | 242/86.5 R |
| 613,138 | 10/1898 | Gempeler | 242/86.5 R |
| 1,441,462 | 1/1923 | Tuttle | 242/125.1 |
| 2,099,102 | 11/1937 | Brown et al. | 242/77.4 |
| 2,549,224 | 4/1951 | Moldovan | 242/86.4 X |
| 2,601,660 | 6/1952 | Jarmicki | 242/77.3 |
| 3,152,772 | 10/1964 | Schjerven | 242/94 |

*Primary Examiner*—Stanley N. Gilreath
*Assistant Examiner*—John M. Jillions
*Attorney, Agent, or Firm*—Robert E. Geauque

[57] ABSTRACT

A transportable cable reel having a rotatable drum secured to an axle and supporting wheels located at opposite ends of the axle, the drum being located between the wheels and having a protective cover at each side thereof to confine cable wound on the drum and to prevent insertion of an object through the spokes of a wheel and the rods supporting the drum.

3 Claims, 4 Drawing Figures

TRANSPORTABLE CABLE REEL

BACKGROUND OF THE INVENTION

Electrical cable for use in the wiring of buildings and other structures is usually wound on a wooden drum and is pulled into the building through conduits which are built into the structure. Several types of pullers are used to pull the cable into the conduits and the cables include the various wires for use in the wiring of the structure. It has been the practice to insert an axis through these wooden drums and to support each end of the axis at opposite sides of the drum by a jack. The cable is then pulled directly from the original wooden drums. The jacks must be loacted in the proper position to permit the drum to rotate and feed the cable in the direction of the pull. After one pull is completed, it is necessary to remove the jacks and move the wooden drum to the next pull location and this also requires moving the jacks to the next location and then remounting the drum again on the jacks. Such an operation is time consuming and requires extensive handling of the drum and jacks.

It has been proposed, in U.S. Pat. Nos. 3,152,772 and 1,726,137, to mount a drum on an axle and to support the axle at opposite ends on wheels of larger diameter than the drum and in U.S. Pat. No. 1,461,939, the drum can be rotated by a crank external to the mounting wheels. These devices are unnecessarily complicated and expensive to manufacture and do not provide the mobility required for the feeding of cable into conduits at numerous locations.

SUMMARY OF THE INVENTION

The present invention provides a transportable cable reel having a drum mounted on an axle and the supporting wheels are located at opposite ends of the axle. Each supporting wheel includes a hub mounted on the axle and connected to the wheel rim by spokes extending outwardly from the hub. Also, rods extend outwardly from opposite sides of the drum in order to confine the cable on the drum as the wound diameter of the cable increases in size. Since the cable drum and the supporting wheels both utilize supporting spokes or rods, a protective panel is mounted on the outside of the drum rods so that it is impossible to insert any object through the spokes of the supporting wheels and through the rods of the cable drum. The axle is provided with a socket whereby a crank can be applied to the axle to turn the cable drum while the supporting wheels remain stationary. The wooden drum can be rotated by hand or power devices.

In use, the cable reel of the present invention is first located opposite a standard wooden drum which has its axle supported by jacks and the cable is wound from the wooden drum onto the drum of the present cable reel while the supporting wheels are blocked to prevent movement of the cable reel. The standard wooden drum can be set up and remain at one central point and the cable reel of the present invention can then be easily moved to the various locations where cable pulling is to take place since the wheels are larger in diameter than the cable drum. Either or both of the transporting wheels can be blocked to hold the cable reel while the cable is being drawn from the cable drum. Also, the cable drum is constructed to accommodate various sizes of cable which is wound in parallel along the drurm so that the transportable reel can be moved to various locations requiring different sizes of cable which are on the drum. This eliminates the necessity for separate wooden drums carrying different size cables to be located at these different locations. When the cable is first placed on the drum, it can be pre-cut to the required length so that just sufficient cable will be on the drum for the pull. The cable reel of the present invention thus provides a light, easily movable transporting device for cables which are to be drawn into conduits at various locations and the structure of the device provides for its safe use even though the supporting wheels can be moved independently of the rotating drum upon which the cable is wound.

BRIEF DESCRIPTION OF THE PREFERRED EMBODIMENT

Figure 1:
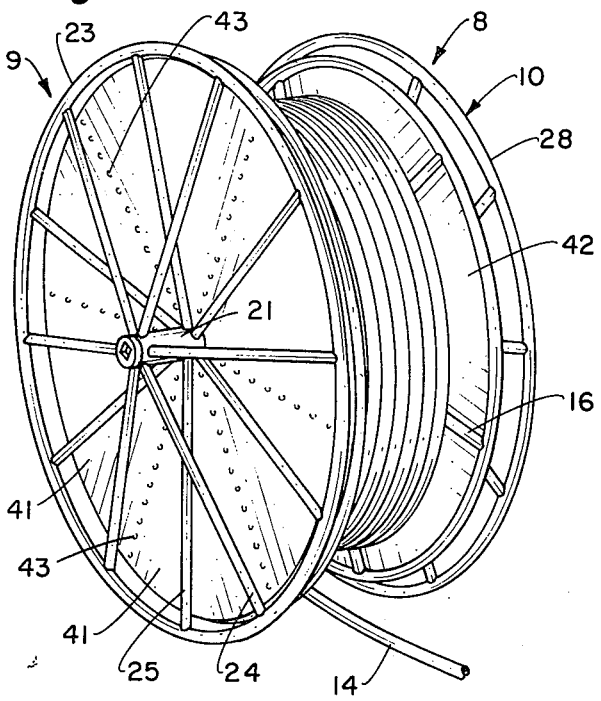
FIG. 1 is a perspective view of the transportable cable reel of the present invention.
Figure 2:
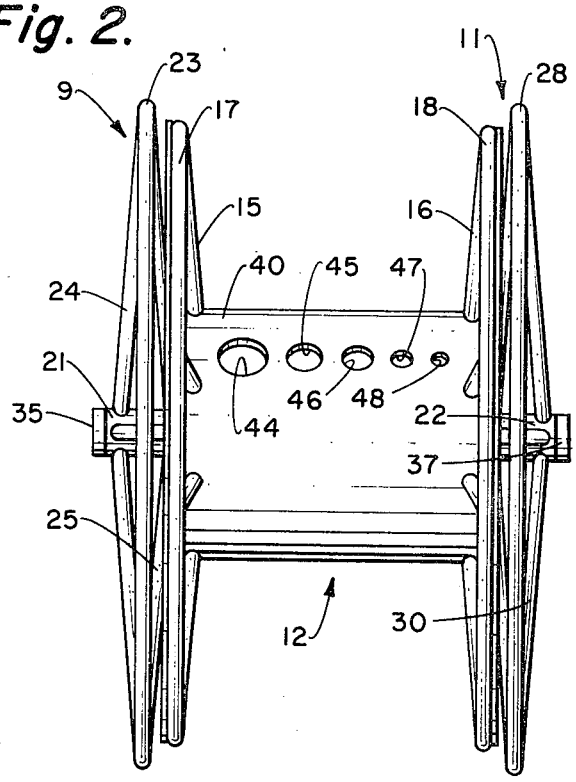
FIG. 2 is a front elevational view of the cable reel of the present invention.
Figure 3:
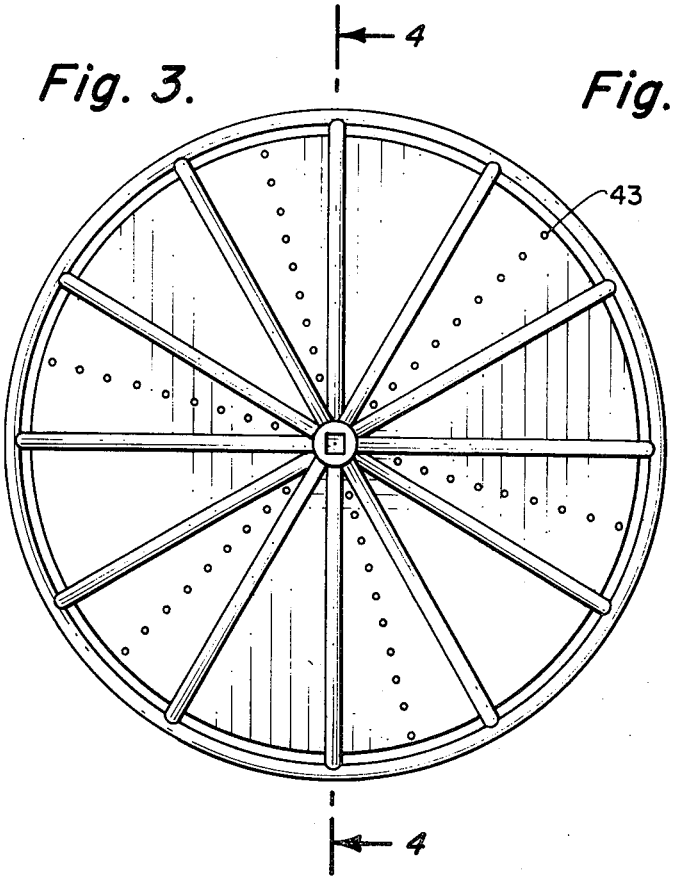
FIG. 3 is a side elevational view taken from the left side of FIG. 2.
Figure 4:
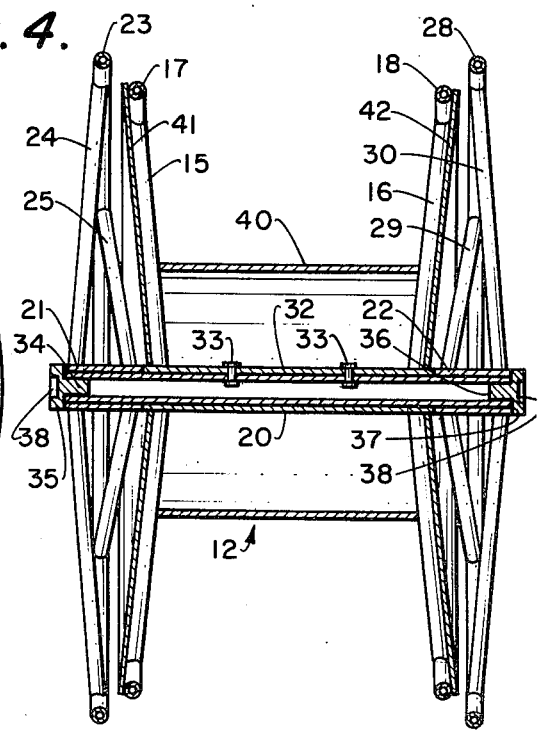
FIG. 4 is a vertical section along line 4—4 of FIG. 3.

The embodiment chosen for illustration in FIG. 1 comprises a transportable cable reel 8 having transport wheels 9 and 11 and a drum 12 upon which is wound able 14 of selected sizes. The cable is confined upon the drum by side supporting rods 15 and 16 located on opposite sides of the drum and terminating in rings 17 and 18, respectively. As illustrated in FIG. 4, the reel 8 has a central tubular axle 20 which rotatably supports at opposite ends rotatable hubs 21 and 22 for wheels 9 and 11, respectively. A rim 23 of wheel 9 is supported by spokes 24 and 25 extending outwardly from opposite edges of the hub 21. Also, a rim 28 of wheel 11 is supported by spokes 29 and 30 extending outwardly from opposite edge of hub 22. The spokes of each wheel can be attached to the rim and hub in any suitable manner, such as welding. An inner cylinder 32 is located between the wheel hubs 21 and 22 and is secured to central axle 20 for rotation therewith in any suitable manner, such as by bolts 33.

A plug fitting 34 is inserted into one end of axle 20 with a press fit and has a flange 35 which overlaps the end of hub 21 in order to retain the hub on the axis 20. In the same manner, a plug fitting 36 is press fitted into the other end of axle 20 and has a flange 37 which overlaps the end of hub 22 in order to retain it on axle 20. Plugs 34 and 36 both have square sockets 38 in which a tool can be inserted in order to rotate drum 12 independently of wheels 9 and 11, as will be later described. Referring again to FIG. 4, an outer cylindrical member 40 surrounds the inner cylinder 32 and has cut-outs at each edge for receiving rods 15 and 16 which are attached to cylinder 32 and at the cut-outs in any suitable manner, such as welding. One side of the cylindrical member 40 and the rods 15 are covered by a cover plate 41 which extends from the inner cylinder 32 radially outward to the rim 17. The cover plate 41 is secured to the rods 15 in any suitable manner, such as by spot welding 43. In a like manner, the opposite side of the drum and rods 16 are covered by a protective cover plate 42 which extends from the inner cylinder 32 to rim 18 and plate 42 is secured to rods 16 by spot welding 43. Protective covers 41 and 42 are somewhat conical in shape and have an opening at the center of sufficient size to receive the inner cylinder 32.

It is apparent that the transportable cable reel 8 consists of transport wheels 9 and 11 having rims 23 and 28 which are slightly larger in diameter than the outer rings 17 and 18 of drum 12; the difference in diameter being preferably 2 inches or more. Because of the difference in diameters, it is apparent that cable can be transported on the wheels 9 and 11 without movement of the drum 14. By the insertion of a suitable crank into either socket 38 and rotation of the crank, the cable drum 12 can be made to rotate separately from the supporting wheels 9 and 11 in either direction. Outer cylindrical member 40 contains a plurality of different sized holes 44 – 48 into which the end of a cable can be inserted in order to cause the cable to wind upon the drum. In the event that more than one size of the cable is to be wound on the drum, the end of each cable can be inserted into a proper size of opening and thus, two or more different sizes of cable can be wound over different portions of the cable drum 12. Wheels 9 and 11 can be blocked while the cable is being wound on or unwound from the drum 12.

It is apparent that relative movement will be taking place between the rods of the drum and the spokes of the wheels while the cable is being wound on the drum, while the reel is being moved on its wheels and while the cable is withdrawn from the drum. Cover plates 41 and 42 make it impossible for an object, such as the arm of the operator, to become injured by extending through both the wheel spokes and drum rods while they are turning at different speeds.

The cable reel of the present invention can be used in a variety of manners in connection with the installing of cable into building conduits. The reel 8 can be rolled into position to connect with cable coming off of a standard wooden drum at a fixed location. This is easily accomplished since wheels 9 or 11 of the cable reel 8 can be moved independently of one another and the wheels can be easily blocked when in the proper location. The end of the cable is inserted into one of the openings in the drum 12 and the drum can be rotated from either side socket 38, in order to take the cable from the wooden drum and wind it onto the transportable cable reel 8. Cables of different sizes can be wound in parallel upon the drum 12 and the desired length of each cable is wound onto the drum before the cable is cut. After the cables that are to be used for the various pulls have been wound on the drum, the blocks for the wheels can be removed and the complete load of cable can be moved from one pulling location to another at which the different sizes are to be used. It is apparent that the drum and wheels can move at different rates, either the same direction or in the opposite direction, during the loading and pulling of the cable and the cover plates 41 and 42 are located to prevent accidents from occurring by the insertion of any object through the spokes of the wheel and into the rods of the drum. The protective plates can be made of 0.025 inches steel plate, since it is not likely that heavy impacts will be received by the plates. In the event that the cable to be wound is larger than any of the holes in the drum, the end of the cable could be connected to one of the rods of the drum by cutting an opening in one of the protective plates 41, 42 for this purpose. The diameter of the holes 44 – 48 can range from 1 to 3 inches and in one size, the drum 12 can hold at least 800 feet of 500 MCM cable having a diameter of about 1 inch. Because of the lightweight construction of the transport reel, it can be easily handled by a minimum of personnel and can be easily loaded and unloaded from mobile equipment used by the contractor. Of course, the size and construction of the drum and wheels can vary depending upon the type of cable to be handled and transported by the reel.

What is claimed is:

1. A transportable cable reel for receiving, transporting and discharging cable, comprising:

a central shaft;

a hub surrounding each end of the shaft end rotatable thereon, a rotating wheel rim being connected to each hub by a plurality of spokes;

a drum comprising an inner cylinder located on said shaft at a location between said hubs and securely connect with said shaft;

a plurality of support rods extending outwardly from sid inner cylinder at each end thereof, a pair of outer rings connected to the outer ends of said rods;

said drum comprising a larger cylindrical member connected to said rods and having a larger diameter than said inner cylinder for receiving the cable wound on the reel;

means for securing the end of said cable to said cylindrical member prior to winding of said cable thereon; and a pair of solid, flat cover plates secured to said rods, each cover plate extending without interruption from an end from said inner cylinder outwardly to one of said rings and having a central opening for receiving said inner cylinder, said cover plates preventing insertion of an object through said spokes of said wheel and between said support rods.

2. A transportable cable reel as defined in claim 1 wherein said securing means comprises a plurality of openings in said cylindrical member for receiving the ends of different sizes of cable to hold said ends while the cable is being wound on said reel.

3. A transportable cable reel as defined in claim 1 having a fitting inserted into each end of said shaft for retaining each of said hubs on said shaft;

each of said fittings comprising means for applying a turning movement to said drum for winding cable thereon.

* * * * *